United States Patent [19]

Jamieson

[11] 4,365,573

[45] Dec. 28, 1982

[54] STEERING GEAR FOR SHIPS

[75] Inventor: John R. Jamieson, Largs, Scotland

[73] Assignee: Vickers Limited, London, England

[21] Appl. No.: 159,627

[22] Filed: Jun. 16, 1980

[30] Foreign Application Priority Data

Jun. 22, 1979 [GB] United Kingdom ..... 7921854

[51] Int. Cl.[3] ..... B63H 25/22

[52] U.S. Cl. ..... 114/150; 91/510; 180/133

[58] Field of Search ..... 114/150; 180/133; 91/509, 510; 60/421

[56] References Cited

U.S. PATENT DOCUMENTS 4,114,720 9/1978 Ericson et al. ..... 180/133
4,136,753 1/1979 Merkel ..... 180/133
4,147,093 4/1979 Dunn ..... 91/510

FOREIGN PATENT DOCUMENTS 2040246 8/1980 United Kingdom ..... 114/150

*Primary Examiner*—Sherman D. Basinger
*Attorney, Agent, or Firm*—Larson and Taylor

[57] ABSTRACT

A ship's steering gear of the type operated by liquid under pressure incorporates two liquid systems each containing a pump fed from its own supply tank and a thruster unit capable of providing by itself steering action on a steering member. The two systems are interconnected by way of an isolating valve device. Each tank contains a liquid detecting device arranged on a drop of liquid level in that tank first to close the isolating valve device and on further drop of liquid level to stop the pump fed from the tank and start the pump in the other liquid system if it is not operating already.

12 Claims, 3 Drawing Figures

STEERING GEAR FOR SHIPS

Figure 1:
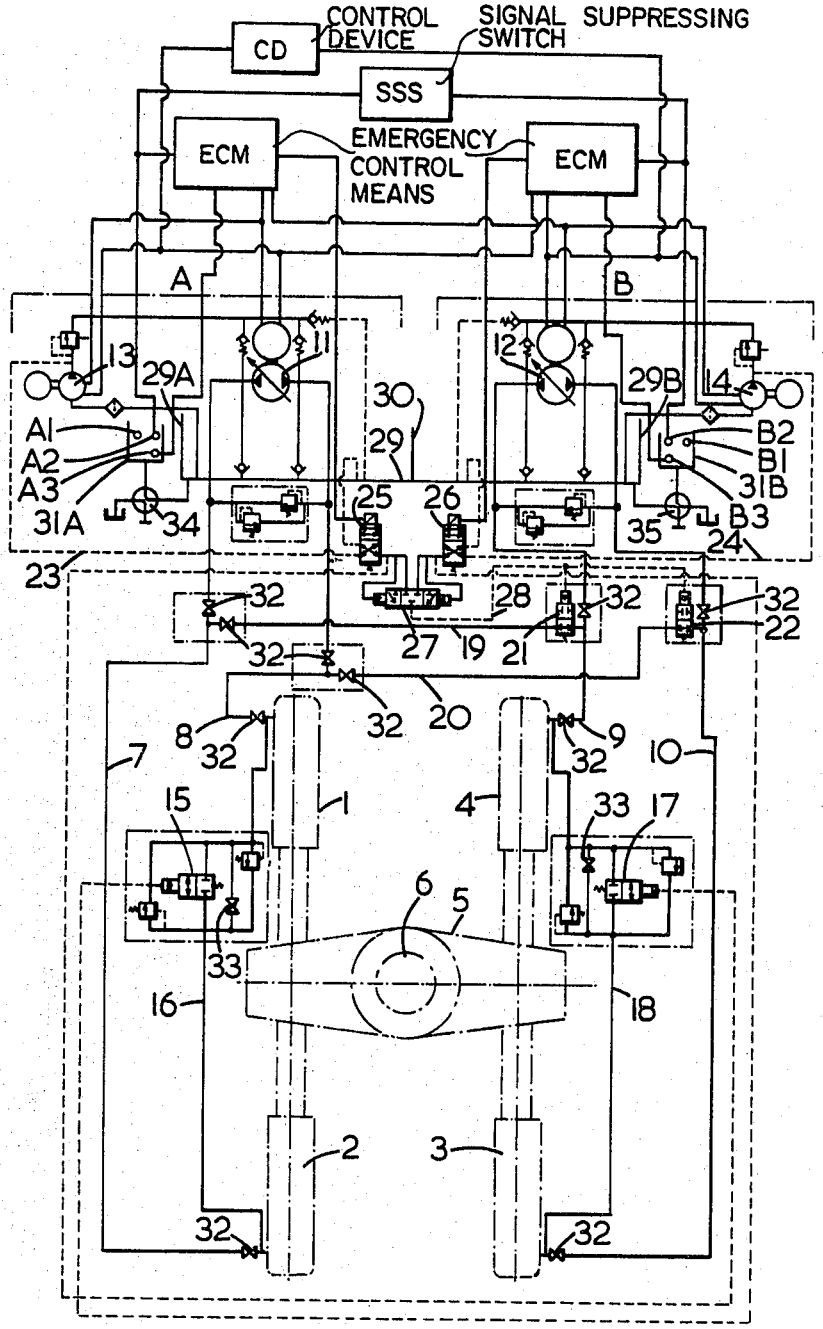

This invention relates to steering gear for ships and particularly to steering gear of the type in which liquid under pressure is used as the medium for applying the steering force.

A ship's steering gear of the type employing liquid under pressure as the medium for applying the steering force customarily incorporates a rudder having a stock to the upper end of which there is attached a cross bar, opposite ends of the cross bar being arranged to pistons slidable within cylinders to which liquid under pressure is admitted or discharged according to the steering action being performed. The customary arrangement is for four single acting cylinders to be employed arranged two in opposition to one another at each end of the cross bar. Where space is limited two double acting cylinders may, however, be employed. Liquid is pumped to the cylinders from at least one liquid pump by way of valves which are closed and opened by the steering control, the arrangement being that when the rudder is being swung in any particular direction two cylinders are being fed with liquid under pressure. In a four cylinder arrangement two cylinders diagonally opposite one another are being fed with liquid under pressure and the other two cylinders diagonally opposite one another are discharging. In a two cylinder arrangement the one piston is pushing and the other piston is pulling. The two cylinders on the same side of the cross bar are usually also connected by way of shock and by-pass valves which are arranged to open when excessive pressure arises in either of the cylinders and the shock and by-pass valve arrangement usually includes a manually operated valve which can be opened to provide a permanent connection between the two cylinders or between the opposite sides of the piston of each double acting cylinder.

With the arrangement described if a leak should occur in the liquid supply system the operating liquid ultimately drains from the entire system through the leak and leaves the system inoperative so that all power steering is lost.

Steering gears using liquid pressure for operation in which occurrence of even a serious leak in any part of the fluid system still leaves steering power available have been proposed but in the known devices the safety apparatus providing the safety features is active all the time the gear is in normal use. It is an object of the present invention to provide a steering gear which acts immediately on occurrence of a leak in any part of the system to take counter-measures to permit steering action to continue but in which during normal operation the safety apparatus is out of action and remains so until a leak occurs.

A steering gear of the type described according to the invention incorporates two liquid-operated thruster units each arranged to provide power movements alternatively in opposite rotational direction to a steering member, two pumps, two liquid supply tanks one for each pump, two pipe systems each containing a pump and a thruster unit, a liquid-conducting connection between the two pipe systems, an isolating valve device operable to close the liquid-conducting connection to isolate the pipe systems from one another, two two-level liquid detecting devices one in each tank, each arranged to detect and issue separate consecutive signals when the liquid level in the associated tank drops to a first lower level and then a second lower level and emergency control means arranged to be operative to close the isolating valve device when a liquid-detecting device operates to signal that the first lower level has been reached in the associated tank and also to be operative to control the pumps so that when a liquid-level detecting device signals that the second lower level has been reached in a tank to render inoperative the pump fed from that tank and to render operative the other pump if it is not already operative.

The steering gear may be arranged for automatic or manual emergency operation.

The emergency control means may be arranged so that when rendering a chosen pump inoperative it interconnects all the liquid-receiving spaces of the thrusters of the thruster unit associated with that pump to provide free passage of liquid between all said spaces.

In a system arranged for fully automatic operation the emergency control means is arranged to operate automatically when a two-level liquid detecting device detects a drop in liquid level to the first lower liquid level in the associated tank to issue a signal to the isolating valve device and on a further drop in liquid level to the second lower liquid level in the associated tank to render inoperative the pump fed from the associated tank and render operative the other pump if it is not already operative.

The two-level liquid detecting device in an automatic system may also be arranged to activate an alarm device on detecting a drop in liquid level in a tank.

The automatic system may include a device operative only when both pumps are running to arrange that the normal two consecutive actions of the liquid level detecting devices, i.e. to close the isolating valve device and to render inoperative the associated pump and render operative the other pump are both performed when the liquid level reaches the first lower level. The automatic system may incorporate a selection facility e.g. a switching device operative to suppress the signal issued by a preselected one of the liquid detecting devices if the liquid level detecting devices issue simultaneous signals indicating a simultaneous drop to the first lower liquid level in both tanks. Alternatively the liquid detecting devices in the two tanks may be located at different distances below the normal operating liquid levels in the two tanks to provide the selection facility by detecting different first lower liquid level, the device located nearer the surface becoming operative first when the levels in the two tanks drop at the same rate.

In a system arranged for operation under manual control the two-level liquid detecting devices are connected to separate alarm devices arranged to warn successively of a first drop in liquid level and then of a further drop in liquid level in each tank, the emergency control means incorporates manually operable switches in the electrical circuits of the driving motors for the pumps and there is provided a reset device operative to render both pumps operative and to cancel operation of the isolating valve devices whereby to open the liquid-conducting connection between the two pipe systems.

The alarm devices may be audible or visual devices.

In a manually controlled system the emergency control means may be grouped at a control point, for example a control panel or console, which may incorporate alarm devices arranged to receive warning signals issued by the liquid level detecting devices, a cancelling device for deactivating the alarm devices, switches operative to control the isolating valve device, a reset device for resetting the isolating valve device to open the liquid-conducting connection, switches for starting and stopping the driving motors of the pumps, and tell tale indicating devices arranged to indicate a change in the liquid level occurring in a tank, and the operational state of the pumps and of the isolating valves. There may also be provided a test button arranged when actuated to feed operating current simultaneously to all the tell tale devices to test that they are all in working order.

Two or more such control panels or consoles may be provided at points remote from one another.

The two liquid supply tanks may be connected to one another at a level above that of the two-level liquid detecting devices. In one construction the two liquid supply tanks are constituted by the portions of a tank on each side of a weir dividing the tank, the normal operating liquid level being above the top of the weir.

Each liquid supply tank may comprise a main tank connected to an auxiliary tank in which the associated two-level liquid detector is located, the connection of each main tank to the associated auxiliary tank including a test valve having two operative settings in one of which the main tank is freely connected to the associated auxiliary tank so that the liquid levels in the two tanks are the same and in the other of which the auxiliary tank is isolated from the associated main tank and is connected to a drain.

The isolating valve device may be arranged to be pressure-operated and to be open when unpressurized.

A by-pass pipe incorporating a by-pass valve may be provided to connect the liquid-receiving spaces of each thruster unit.

The by-pass valve may be of the pressure-operated type being arranged to be closed when unpressurized. To control the isolating valve device and the by-pass valves there may be provided a servo-system incorporating two electrically operated pilot valves normally closed when unenergized and each arranged when energized to provide a connection for operating liquid from a respective liquid supply to a fluid pressure operated changeover valve arranged on energization of either pilot valve to connect the energized pilot valve to the isolating valve device and to the by-pass valve of the other liquid circuit, each pilot valve being electrically connected to the two-level liquid-detecting device in the respective supply tank, each pilot valve being arranged to be energized when the liquid level in its respective tank drops to the first lower level in that tank.

Each servo-system may include an auxiliary pump arranged to supply operating pressure to the servo-system and may also be arranged to operate as a lubricating pump for the main pump of the associated pipe system.

Figure 2:
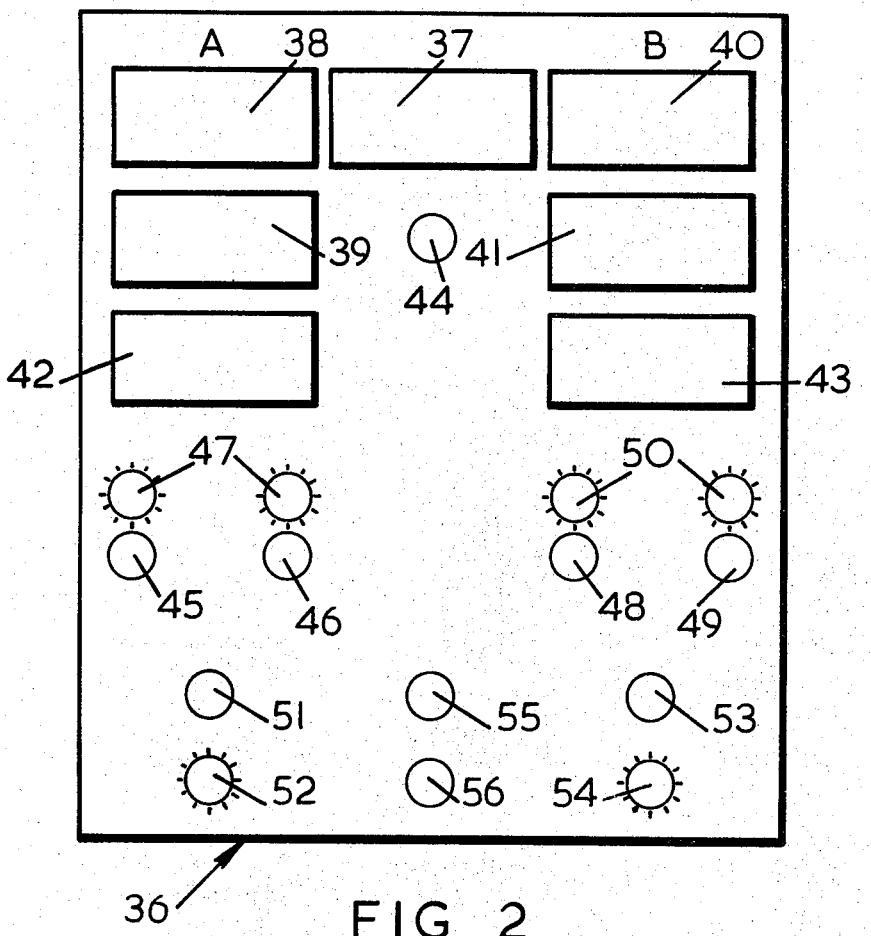
Figure 3:
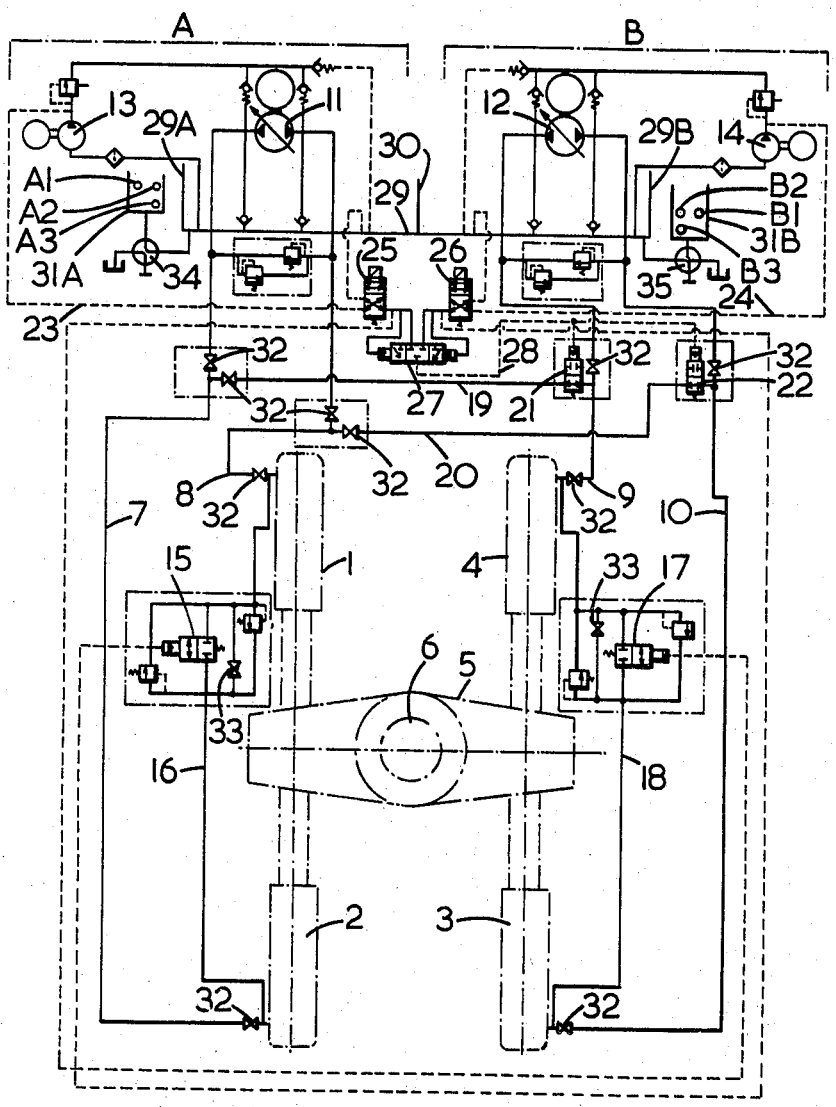

A practical embodiment of the invention arranged for completely automatic operation is illustrated diagrammatically in FIG. 1 of the accompanying drawings while FIG. 2 illustrates a control panel for use with a gear arranged for manual control and FIG. 3 illustrates an alternative embodiment to that shown in FIG. 1. The control panel constitutes the emergency control means in a manually controlled steering gear.

In the drawings, 1, 2, 3 and 4 denote respective single acting thruster cylinders of which 1 and 2 constitute one thruster unit and 3 and 4 constitute the other thruster unit. The pistons of the cylinders are coupled to a cross bar 5 fixed to a rudder stock 6. 7 and 8 denote two liquid circuits, the circuit 7 being associated with the thruster cylinder 2 and the circuit 8 being associated with the thruster cylinder 1. Similarly 9 and 10 denote liquid circuits of which the circuit 9 is associated with the thruster cylinder 4 and the circuit 10 is associated with the thruster cylinder 3. The liquid circuits 7 and 8 form a pipe system connected to the branches of a reversible variable delivery pump 11 and the liquid circuits 9 and 10 are connected to the branches of a reversible variable delivery pump 12. All the piping associated with the pumps 11 and 12 and the thruster units constituted by the cylinders 1, 2 and 3, 4 constitute pipe systems referred to for convenience as pipe systems A and B respectively. The variable delivery pump 11 operates in conjunction with an auxiliary pump 13 and the variable delivery pump 12 operates in conjunction with an auxiliary pump 14. 15 denotes a pressure-operated by-pass valve intercalated in a by-pass passage 16 connecting the two liquid pressure circuits 7 and 8, and 17 denotes a pressure-operated by-pass valve intercalated in a by-pass passage 18 connecting the liquid circuits 9 and 10. The valves 15 and 17 are so arranged that they are closed when unpressurized. 19 denotes an interconnecting pipe interconnecting the liquid circuits 7 and 9, and 20 denotes an interconnecting pipe interconnecting the circuits 8 and 10. The interconnecting pipes 19 and 20 constitute the liquid conducting connection between the two pipe systems A and B. Intercalated in the circuit 9 there is a pressure-operated isolating valve 21 and intercalated in the interconnecting pipe 20 there is a pressure-operated isolating valve 22. The valves 21 and 22 constitute the isolating valve device. The valves 21 and 22 are open when unpressureized. The outputs of the auxiliary pumps 13 and 14 are fed respectively by conduits 23 and 24 which are connectible by means of respective electrically operated pilot valves 25 and 26 to a pressure-operated changeover valve 27 which contains a movable member reciprocable between two extreme end positions. The conduits 23 and 24 are also arranged to be connectible to the by-pass valves 17 and 15 respectively by means of the pilot valves 25 and 26. The pilot valves 25 and 26 are in the positions shown when they are unenergized. The main pumps 11 and 12 and the auxiliary pumps 13 and 14 are arranged to draw liquid from a tank 29, in effect a single tank forming two separate tanks 29A and 29B by a weir 30. Open to the separate tanks separated by the weir 30 are two auxiliary tanks 31A and 31B so that the liquid in these auxiliary tanks 31A and 31B is at the same level as the liquid in the main tanks 29A and 29B. Located in the auxiliary tank 31A there are three liquid level switches A1, A2 and A3 constituting a two-level liquid-detecting device. The switch A3 is below the level of the switches A1 and A2, and in the auxiliary tank 31B there are located three liquid level switches B1, B2 and B3 constituting another two-level liquid-detecting device. The switches A1 and B1 are connected to an alarm device to be operated when the liquid level drops in the associated tank to a first lower level. The switches A2 and B2 which operate at the same first lower liquid level as the switches A1 and B1 are connected to control operation of the pilot valves 25 and 26 respectively, the arrangement being that if the liquid level drops to the first lower level in one of the tanks the respective pilot valve 25 or 26 is energized. The switch A3 is connected into the power circuit of the driving motor of the pump 11 so that if the liquid level drops to the second lower level the pump 11 will be stopped and the main pump 12 and the auxiliary pump 14 started if they are not already running, the pilot valve 26 being thereupon energized. Similarly the switch B3 is operative to stop the pump 12 and start the pump 11 and the auxiliary pump 13 if they are not already running. There may be optionally provided for a reason to be explained a switching device operative only when both pumps are in use to cause the switches A2 and B2 to be arranged to perform additionally the switching functions of A3 and B3.

The valves 32 are manually operable valves which are normally permanently open and the valves 33 are manually operable valves which are normally permanently closed. The valves 32 and 33 are not part of the safety apparatus and are operated only when it is necessary to override the automatic steering gear or to perform maintenance or repairs.

34 and 35 denote test valves by which a leak can be simulated in either of the pipe systems A or B to test that the safety apparatus is in working condition.

With reference to FIG. 2, 36 denotes a control panel presenting several tell tale indicating devices and the appropriate switches for operating the system under manual control. 37 denotes a tell tale arranged to indicate a drop in level in an emergency storage tank arranged to supply the storage tank 29 when oil is lost from the system. The emergency tank is not part of the present control system and is not illustrated. 38 and 39 are tell tales arranged to indicate when the level in the tank 29 A has dropped to the first lower level and to the second lower level respectively. 40 and 41 are tell tales arranged to indicate when the level in the tank 29B has dropped to the first lower level and the second lower level respectively. 42 and 43 are arranged to indicate a failure in the servo-systems of system A and system B respectively e.g. a drop in pressure in these sections. 44 denotes an operating button for cancelling operation of the alarm associated with the warning indicated by the devices 38, 39, 40. 45 and 46 denote respectively start and stop buttons for the motor driving the pump associated with system A and 47 denotes indicator lamps showing which button 45 or 46 has been pressed. 48 and 49 denote respectively start and stop buttons for the motor driving the pump associated with system B and 50 denotes indicator lamps showing which bottom 48 or 49 has been pressed. 51 denotes an operating button arranged to operate the valves 21 and 22 constituting the isolating valve device and for interconnecting the liquid receiving spaces of the thruster unit of system A (by opening the valve 15). 52 denotes an indicator lamp showing that the button 51 has been operated. 53 denotes a button arranged to operate the valves 21 and 22 constituting the isolating valve device and also to interconnect the liquid-receiving spaces of the thruster unit of system B (by opening the valve 17). 54 denotes an indicator arranged to show when button 53 has been pressed. 55 denotes a reset button operation of which is arranged to open the valves 21 and 22, to close the valve 15 or 17 whichever one is open, and to render both pumps 11 and 12 operative. 56 denotes a test button operation of which activates all the indicating devices 37, 38, 39, 40, 41, 42, 43, 47, 50, 52 and 54 so that they can be seen to be all operative and capable of giving the required information should the situation arise.

In the system arranged for manual control the switches A2 and A3 in the tank 31A are arranged to operate the tell tales 38 and 39 (FIG. 2) and the switches B2 and B3 in the tank 31B are arranged to operate the tell tales 40 and 41. The valves 25 and 26 in the manual control gear are under the control of the buttons 51 and 53 respectively.

In practice, a steering gear as described may be operated for steering purposes in several different ways. In the most usual circumstances in calm weather and in open sea one pump may be operated to supply reduced power to all four thruster cylinders or in rough conditions or in difficult sea channels where full steerage power is required both pumps may be operated to supply full power to all four thruster cylinders.

In the gear arranged for automatic operation and in the circumstances where one pump is operating and is supplying operating liquid to all four thrustor cylinders and a leak occurs somewhere in the entire circuit and suppose for example it is the pump 11 which is in operation, the loss of liquid from the system A will result in the level of liquid in the tank 29A starting to drop because liquid is escaping from the leak and is not being returned to the tank 29A. As the level drops to the first lower level of the switches A1 and A2 these switches become activated, A1 switches current to an alarm to give an indication that a leak has occurred while the switch A2 energizes the associated pilot valve 25. A through-passage for operating liquid is now provided by the servo-system of system A from the auxiliary pump 13 through the conduit 23 to the changeover valve 27. As the pump 14 is not in operation since the main pump 12 is not in operation pressure is supplied only to the end of the changeover valve 27 connected to the changeover valve 27. The movable member of the pilot valve 27 is then moved over so that the conduit 23 is put in communication with the conduit 28 while the conduit 24 is isolated from the conduit 28. Liquid under pressure then is applied to the valves 21 and 22 and these valves are both closed, closing off the interconnecting pipes 19 and 20 and isolating the pipe system A from the pipe system B. Also the liquid under pressure from the conduit 23 passing through the valve 25 is fed to the by-pass valve 17 which opens and puts the cylinders 3 and 4 in permanent communication so that they will not hinder steering action which will still be applied by the cylinders 1 and 2. If the leak should be in the system B steering will now continue normally at half power by the pressure applied by the pump 11 to the cylinders 1 and 2 while the pistons of the cylinders 3 and 4 move freely in their respective cylinders. Because the leak is now isolated from the pump 11 there will be no further fall in the liquid level in the tank 29A so that steering can continue by this system indefinitely. Should it be, however, that the leak is in the system A, when the valves 21 and 22 close isolating the two systems A and B liquid will still continue to be lost from the system A through the leak and the liquid level in the tank 29A will continue to drop until it reaches the level of the switch A3 in the auxiliary tank 31A. This switch when activated now shuts down the pump 11 and the auxiliary pump 13, energizes the pump 12 and its auxiliary pump 14 and energizes the pilot valve 26. Pressure now drops in the system A and in the associated servo-system and rises in the system B and in the associated servo-system. The starting of the pumps 12 and 14 coupled with energization of the pilot valve 26 directs pressure fluid now to the other side of the changeover valve 27 and this valve now moves over to the position in which pressure liquid from the conduit 26 is now applied to the conduit 28 thus causing the valves 21 and 22 to remain closed, or to reclose immediately if they had opened. The system B is thus maintained isolated from the system A. As in this new situation the leak is now isolated from the circuit containing the pumps 12 and 14 steering may now continue at half power using the thruster unit of system B, i.e. the cylinders 3 and 4. The pressure liquid applied through the valve 26 is also applied to the by-pass valve 15 while the pressure is removed from the by-pass valve 17. The cylinders 1 and 2 are then interconnected and the pistons can move freely, the steering power being applied by the cylinders 3 and 4.

In the circumstances where both pumps 11 and 12 with their associated auxiliary pumps 13 and 14 are operating when a leak occurs the liquid level in both tanks 29A and 29B and the auxiliary tanks 31A and 31B will fall. If the leak is in such a position that the liquid level in one tank drops faster than it does in the other say in the tank 29A and because both pumps are running the switches A2 and B2 are arranged to perform the switching function of A3 and B3 are previously described, on the level dropping to the level of the switch A2 this switch operates to close the valves 21 and 22 by operation of the pilot valve 25 and the shuttle valve 27 and at the same time and without waiting for the switch A3 to be be operated shuts down its associated pump 11, leaving the pump 12 operating. The action thereupon becomes the same as for single pump operation and if the leak is in system A steering action continues by system B. If however the leak is in system B the result will be that the liquid level will continue to fall in the tank 29B and first the switch B2 will become operated to maintain closed the valves 21 and 22 and next the switch B3 will become operated to stop the pump 12 and restart the pump 11 whereupon the steering action will be continued by the system A. The provision for causing the switches A2 and B2 to perform additionally the switching functions of A3 and B3 when both pumps are running is desirable but not essential. It saves the time of waiting for the liquid level to drop from A2 to A3 or B2 to B3. It can be used only when both pumps 11 and 12 are in use which is when full steering power is in use and when saving of time is likely to be most important. A control device for providing this facility is indicated at CD in FIG. 1.

If the leak is in such a position that the liquid level falls at the same rate in both tanks so that each switch A3 and B3 tries to cut out its associated pump and cut in the other pump, the preset selector facility referred to provides preference of operation of one liquid system over the other so that the favoured pump continues running to test for the position of the leak and depending on whether the leak is in its associated pipe system or is in the other pipe system, cuts itself out and cuts in the other system or remains operating and keeps the other liquid system inoperative, all in the manner already described. A signal suppressing switch is indicated at SSS in FIG. 1.

In operation of the system arranged to be controlled manually, operation of the various components is the same as for the automatic system shown illustrated in FIG. 1. However, certain parts of the system do not come into operation automatically and have to be brought into operation from the control panel 36 constituting the emergency control means. Such emergency control means are indicated at ECM in FIG. 1. In the operation of the manual gear if the tell tale 38 and its alarm give warning that the liquid level has started dropping in the tank 29A an operator at the panel first of all presses the button 44 to deactivate the alarm and presses both buttons 45 and 48 to ensure that both pumps 11 and 12 are operating. One of them at least will be operating already. Next he presses the button 51. The effect of this is to close the valves 21 and 22 and open the valve 17 of the thruser unit in system B. He then waits for a reaction to these operations. The effect of these operations is now to leave only system A providing steering power. If the tell tale 39 and its alarm now becomes activated showing that the level in the tank 31A is continuing to drop and indicating that the leak is in the system A he uses the button 44 to cancel the alarm associated with the device 39 then presses the button 46 to stop the pump of system A and presses the button 53. The activation of the valve 26 causes closure of the valves 21 and 22 and also opens the valve 15. This now transfers the operation of steering the ship to the system B.

After the leak has been repaired the reset button is pressed to close the isolating valve device and the open by-pass valves thus restoring the gear to normal operating conditions.

The steering gear of the invention has the great advantage that when working normally all the components of the safety apparatus are unused and suffer no wear. They are brought into use only when a leak occurs. They should thus have a long trouble-free life.

To test that the safety apparatus is in working order the test valves 34 and 35 are manipulated. This can be done in several different ways with either or with both pumps 11 and 12 running so as to simulate the occurrence of leaks in the pipe system A and the pipe system B and under different running conditions. Briefly stated, setting the valve 34 or 35 to connect the auxiliary tank 31A or 31B to drain causes the liquid level in the tanks 29A or 29B or 31A or 31B to drop and simulate a leak. For example, running the pump 11 only and discharging only enough liquid from the auxiliary tank 31A to bring the liquid level to the first lower level, that of the switch A2, then resetting the valve 34 to stop further discharge of liquid from the auxiliary tank 31A simulates a leak in the system B. Allowing the auxiliary tank 31A to discharge to the second lower level, that of the switch A3, simulates a leak in the system A.

The switching device capable of providing the selection facility and the device operative to combine the function of the switches A2 and A3 and B2 and B3 may employ conventional circuitry and do not require to be described.

As described above, in an alternate embodiment illustrated in FIG. 3, the two-level liquid detecting devices A1, A2, A3 and B1, B2, B3 are located in the respective tanks 31A, 31B at different distances below the normal operating liquid levels in the two tanks to provide the selection facility by detecting different first lower liquid levels in the two tanks.

What is claimed is:

1. A steering gear incorporating two liquid-operated thruster units each arranged to provide power movements alternatively in opposite rotational direction to a steering member, two pumps, two liquid supply tanks one for each pump, two pipe systems each containing a pump and a thruster unit, a liquid-conducting connection between the two pipe systems, an isolating valve device operable to close the liquid-conducting connection to isolate the pipe systems from one another, two two-level liquid detecting devices one in each tank, each arranged to detect and issue separate consecutive signals when the liquid level in the associated tank drops to a first lower level and then a second lower level and emergency control means arranged to be operative to close the isolating valve device when a liquid-detecting device operates to signal that the first lower level has been reached in the associated tank and also to be operative to control the pumps so that when a liquid-level detecting device signals that the second lower level has been reached in a tank to render inoperative the pump fed from that tank and to render operative the other pump if it is not already operative.

2. A steering gear as claimed in claim 1, in which each thruster unit comprises opposed thruster cylinders having liquid-receiving spaces, by-pass pipes connecting the liquid-receiving spaces of each thruster unit, by-pass valves intercalated in the by-pass pipes and emergency control means arranged to control the by-pass valves.

3. A steering gear as claimed in claim 1 in which each two-level liquid detecting device is arranged to be operative when it detects a drop in liquid level to the first lower liquid level in the associated tank to issue a signal to the isolating valve device to cause it to operate to close the isolating valve device to isolate the two pipe systems and on a further drop in liquid level to the second lower liquid level in the associated tank to issue a signal to the emergency control means to render inoperative the pump fed from the associated tank and render operative the other pump if it is not already operative.

4. A steering gear as claimed in claim 1 including tell tale devices each arranged to be activated by an associated two-level liquid detecting device when said detecting device detects a drop in liquid level in the tank associated therewith.

5. A steering gear as claimed in claim 1 incorporating a selection facility operative to select one particular pump to be operative in preference to the other if the liquid level detecting devices detect a simultaneous drop to the first lower liquid level in both tanks.

6. A steering gear as claimed in claim 5 in which the selection facility comprises a switching device operative when both two-level liquid detecting devices become operative simultaneously to suppress the signal issued by a particular one of the liquid detecting devices.

7. A steering gear as claimed in claim 5 in which the two-level liquid detecting devices in the two tanks are located at different distances below the normal operating liquid levels in the two tanks to provide the selection facility by detecting different first lower liquid levels in the two tanks.

8. A steering gear as claimed in claim 1 incorporating alarm devices operatively connected to the two-level liquid detecting devices.

9. A steering gear as claimed in claim 1 in which the emergency control means incorporates manually operable switches arranged to control the driving motors of the pumps and there is provided a reset device operative to render both pumps operative and to cancel operation of the isolating valve device whereby to open the liquid-conducting connection between the two pipe systems.

10. A steering gear as claimed in claim 9 in which the manually operable switches are grouped at a control point at which are located alarm devices arranged to receive warning signals issued by the liquid level detecting devices, switches operative to control the isolating valve device, a reset device for resetting the isolating valve device to open the liquid-conducting connection, switches for starting and stopping the driving motors of the pumps, and tell tale indicating devices arranged to indicate changes in the liquid level occurring in a tank and the operational state of the pumps and of the isolating valve device.

11. A steering gear as claimed in claim 1 in which each liquid supply tank comprises a main tank, an auxiliary tank to which the main tank is connected and in which the associated two-level liquid detecting device is located and a test valve intercalated in the connection of each main tank to the associated auxiliary tank, the test valve having two operative settings in one of which the main tank is freely connected to the associated auxiliary tank so that the liquid levels in the two tanks are the same and in the other of which the auxiliary tank is isolated from the associated main tank and is open to a drain.

12. A steering gear as claimed in claim 1 including a device arranged to be operative only when both pumps are in operation to cause each two-level liquid detecting device to be operable to perform all its switching functions simultaneously when activated by a drop in liquid level in the associated tank to the first lower level.

* * * * *